United States Patent [19]

Nauheimer

[11] 4,439,920

[45] Apr. 3, 1984

[54] DISPOSABLE RAZOR

[76] Inventor: Vincent J. Nauheimer, 121 Oneida Ave., Croton, N.Y.

[21] Appl. No.: 370,610

[22] Filed: Apr. 22, 1982

[51] Int. Cl.[3] ..... B26B 21/00

[52] U.S. Cl. ..... 30/47

[58] Field of Search ..... 30/47, 32

[56] References Cited

U.S. PATENT DOCUMENTS

| | | | |
|---|---|---|---|
| 2,699,602 | 1/1955 | Finley | 30/47 |
| 2,716,810 | 9/1955 | Koval | 30/47 |
| 2,737,714 | 3/1956 | O'Gatty | 30/47 |
| 2,871,560 | 2/1959 | Eberbaugh | 30/47 |
| 3,492,722 | 2/1970 | Sieve | 30/47 |
| 3,492,723 | 2/1970 | Mollica | 30/47 |
| 3,750,280 | 8/1973 | Le Paliscot | 30/47 |

*Primary Examiner*—Jimmy C. Peters

*Attorney, Agent, or Firm*—James J. Burke, II

[57] ABSTRACT

A disposable, "match box" razor including novel means for maintaining the shaving head in an operative position, a pattern of "living hinge" score lines that facilitates easy opening and closing, and ball-and-socket snaps that maintain the razor in either the open or closed position. The razor can be fabricated either by injection molding or by scoring, cutting, etc. from sheet stock.

4 Claims, 5 Drawing Figures

FIG.1
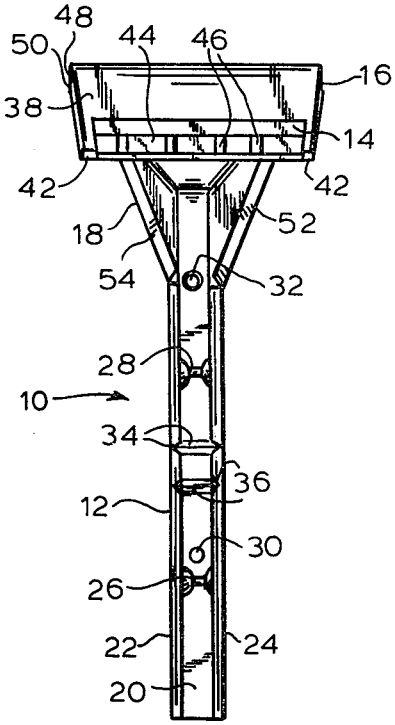
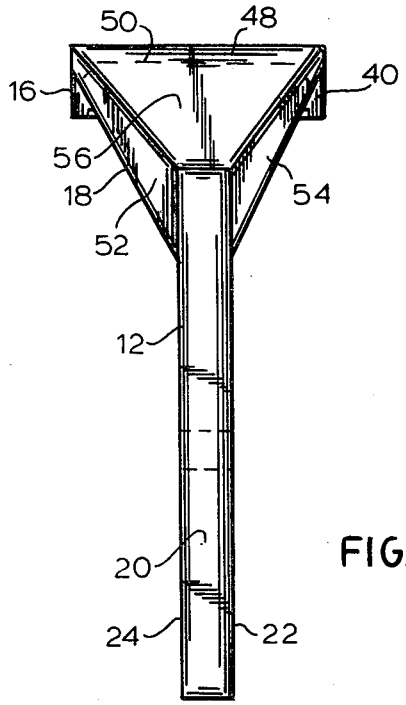
FIG.2
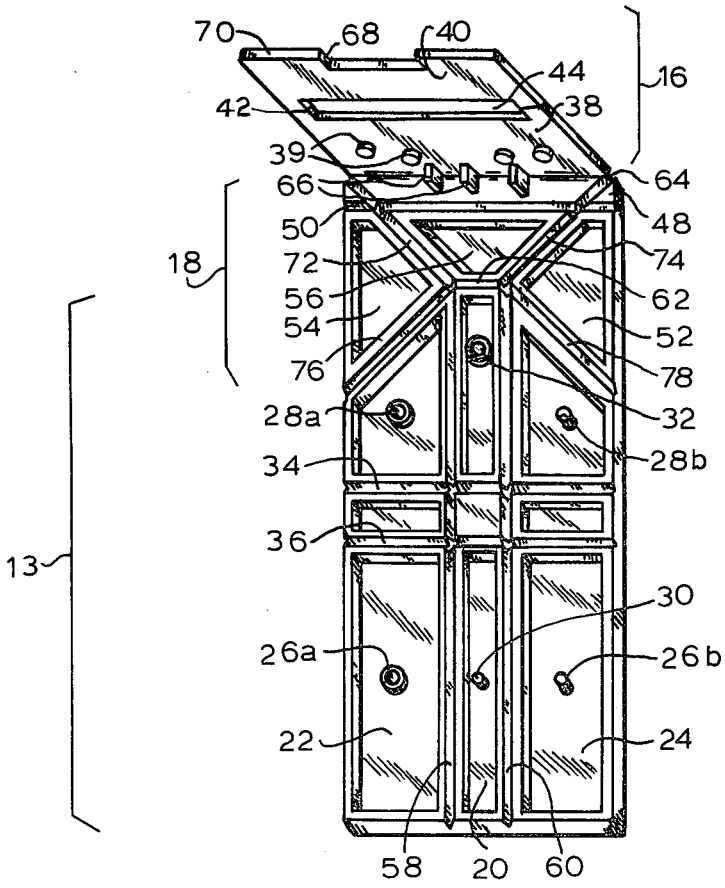
FIG. 3

DISPOSABLE RAZOR

BACKGROUND OF THE INVENTION

The present invention relates in general to razors and, more particularly, it relates to low-cost, disposable razors that are conveniently and safely foldable, may be carried in pocket or purse, and which may be sold or given away as premiums or advertising gifts.

There is a significant patent literature of razors of the general type described, which literature is discussed below. While throw-away or disposable razors have become commercially successful at very reasonable cost, such implements have been comprised of molded plastic handles with an attached head structure, generally involving two or more separate parts. Though the patent literature describes a variety of foldable or "match book" types of razors, insofar as is known none of these have achieved commercial success.

Why this is so will become apparent upon consideration of the several proposed designs.

Perhaps most pertinent to the present invention is the disclosure of Mollica et al, U.S. Pat. No. 3,492,723. This is a "match book" type of razor, with a blade where the striking surface would normally be located, the blade being retained in a folded structure secured by rivets and including an outer flap for retaining the match-book "cover". This razor includes one or two longitudinal fold lines in the cover portion that form a razor handle for the razor head, but it is only the sloping bent-in portions of that handle that support the blade in an appropriate shaving position, and only the stiffness of the material keeps it from moving to an inoperative position, something which could happen with moderate use.

U.S. Pat. No. 2,871,560 of Eberbough discloses a blank which can be folded and permanently glued into a razor configuration, the blank including both scored lines, slit portions and a prefolded and glued head portion including a blade. Tabs extending between the two sections secure the head in an operative position. While this razor would be supplied flat, it is no longer foldable once it is assembled.

U.S. Pat. No. 1,955,132 of Woods and U.S. Pat. No. 2,716,810 of Koval are similar, insofar as each is of the match book type but includes a separate, attachable blade holder.

The patents of Christmas, U.S. Pat. No. 1,875,990 and U.S. Pat. No. 2,075,007 are both of the match book configuration, each with an elaborately folded and stapled blade holder portion, but nothing more than the folded handle portion to hold the blade in an operative position.

Other patents in the same general field, but of lesser interest, are as follows: Levitt et al, U.S. Pat. No. 1,975,365; Finley, U.S. Pat. No. 2,699,602; Biggs, U.S. Pat. No. 2,589,327; Koval, U.S. Pat. No. 2,694,857; and McGirr et al, U.S. Pat. No. 1,991,290.

In this field, it should be noted that the word "disposable" means only that the razor comes with a built-in blade that can not be replaced, so that the entire unit is discarded when the blade wears out. With the excellent quality of blades now available, however, this only occurs after extended use.

OBJECTS OF THE INVENTION

It is a general object of the present invention to provide an improved foldable, disposable razor.

A more particular object of the present invention is to provide a foldable razor that is economical to manufacture and convenient to use.

Another object of the present invention is to provide a foldable razor including means for positively holding the razor in both the open and closed positions, and for maintaining the shaving head in the operative position.

Various other objects and advantages of the invention will become clear from the following description of an embodiment of same, and the novel features will be particularly pointed out in connection with the appended claims.

THE DRAWINGS

Reference will hereinafter be made to the accompanying drawings, wherein:

FIG. 1 is a frontal elevation view of the invention in the operative or unfolded position;

FIG. 2 is a rear elevation of the invention, also in the operative position;

FIG. 3 is a perspective view of a molded "blank" of the razor of the invention;

DESCRIPTION OF EMBODIMENTS

Figure 4:
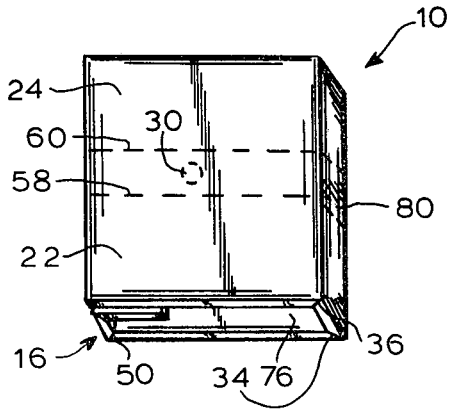
FIG. 4 is a perspective view of the razor of the invention in the inoperative or folded position.

Referring to FIGS. 1 and 2, the razor 10 of the invention comprises a handle 12, a blade 14 and blade holder 16, and a blade holder support 18 connecting the handle 12 and blade holder 16.

More particular, handle 12 comprises a central back wall 20 and two, forwardly-extending side walls 22, 24 forming a general U or channel shape when viewed end-on. A pair of ball-and -socket snap joints 26, 28 extending from side walls 22, 24 retain and secure the handle 12 in this, the operative position.

Also visible in FIG. 1 are a ball 30 and socket 32 located on back wall 20. This snap joint, of the same design as joints 26, 28, is used to hold razor 10 in the folded position, as discussed more fully below. Intermediate ball 30 and socket 32 are a pair of transverse score lines 34, 36, also employed in the folding process.

Blade holder 16 comprises an upper blade support 38, a lower blade support 40 folded under and back against support 38 at bent-back distal edges 42, and a cut-out portion 44 intermediate edges 42 that allows the edge of blade 14 to be exposed. It is preferred that cut-out portion 44 include comb fingers 46 that support blade 14 but allow egress of water and shaving cream therethrough.

Those knowledgeable in the injection molding arts will appreciate that score lines 34, 36, distal edges 42 and other similar structures described below are what are known in this art as a "living hinge". That is, they are injection molded of a thermoplastic material but are of sufficiently thin cross-section so as to be foldable many, many times without fracture. In the case of edge portions 42 these are folded only once when the blade is inserted; with score lines 34, 36 and others, however, folding and unfolding accompanies each use of the razor.

A key feature of blade holder 16, and of the invention in general, is blade-holder back wall 48, which is at a right angle to top surface 38 and rigidly attached thereto. Thus, surface 38 and wall 48 form the long and short legs, respectively, of an "L" shaped rigid member. A further feature of the invention is that back wall 48, at its distal end is integral with and foldably attached to blade-holder support 18 along transverse score line 50.

These features, the living hinge score lines and the pattern of those lines noted below allow the razor of the invention to accomplish all of the objects but a one-piece molded product (except, of course, for the blade 14), which is something not shown in any known prior art design.

Support 18 comprises three sections, integrally related to both handle 12 and blade support 16, these being side walls 52, 54 at either side of and integral with back wall 56.

Construction, functioning and manufacture of the invention can be more clearly seen in FIG. 3, and attention is directed thereto.

FIG. 3 shows a "blank" of the invention as it would appear when removed from an injection molding machine, one possible means of manufacture. This would, as shown, have reinforced edge and score portions, the latter being thin enough to be readily foldable as a living hinge.

In this blanked form, handle 12 and blade-holder support 18 together are rectangular in shape.

Back wall 20 of handle 12 is defined by longitudinal score lines 58, 60 between it and handle side walls 22, 24 and transverse score line 62 between it and holder support back wall 56.

Blade support 16 in the blanked form is joined to support holder 18 at transverse score line 50, and comprises upper and lower surfaces 38, 40, respectively, forming the back or long leg of the "L", and back wall 48, joined to surface 38 at corner 64 and rigidly held at a right angle thereto by reinforcing members 66. To accomodate the latter, lower surface 40 includes a cut-out portion 68 so that when it is bent under (at 42), its distal edge 70 will not interfere therewith. Surface 38 preferably also includes bosses 39 adapted to secure blade 14 in precise registration, and these may be long enough to mate with corresponding holes (not shown) in lower surface 40, but this is optional.

The score lines in blade-holder support section 18 are critical to success of the invention, along with the "L" shape of holder 16. More particularly, these lines form a general "X" shape with line 62 at the center, but the outer, upper ends of the "X" are at the distal edges of corner 64, not score line 50. Thus score lines 72, 74 extend from ends of line 62 to the ends of corner 64, crossing line 50 in the process. Lines 76, 78 extend from the ends of line 62 down and outwardly, forming the bottom legs of the "X". So, side wall 54 is defined by an edge and lines 72, 76; wall 52 is defined by an opposed edge and lines 74, 78; back wall 56 is defined by lines 62, 72, 74 and 50.

That lines 72, 74 cross line 50 is important: when handle side walls 22, 24 are bent into a "U" shape, support side walls 52, 54 bend outwardly, but this forces holder 16 down into an operative position by requiring a downward bend along line 50. In other words, back wall 48 is made to tilt forward, and this brings blade holder 38, 40 etc. into the operative position. Because corner 64 is rigid, it is held in this position as long as handle 12 is snapped together (FIG. 1).

FIG. 4 illustrates the invention in the folded or storage position, and attention is directed thereto. After use, snap joints 26, 28 (FIG. 1) in handle 12 are released, and the unit is flatenned as shown generally in FIG. 3. Thereafter, handle 12 is folded along lines 34, 36 blade support 16 is folded down along line 50, and the bottom edge of the former is folded down over the latter, bringing ball 30 and socket 32 into opposed, closing relation. Score lines 34, 36 in this position define a transverse wall 80 opposed to and spaced from blade support 16, and the unit is retained in this "match box" shape by snap joint 30, 32. It is to be noted that, because of walls 80 and 48 the general configuration in the folded position is rectangular, and hence the name "match box" is applied, rather than "match book" as is common in the prior art designs. It is further to be noted that, particularly for premium and gift use, the major upper and lower outer surfaces (22, 24 only shown in FIG. 4) may bear an advertising message.

Figure 5:
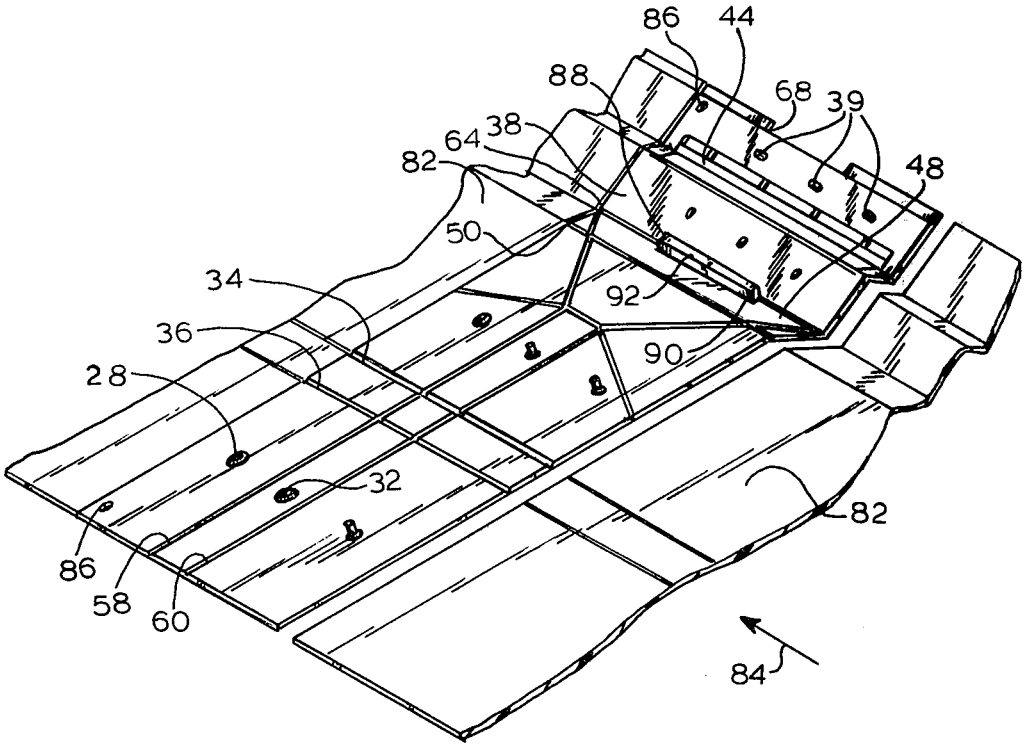
FIG. 5 is a perspective view of a modified embodiment of the invention, as could be manufactured from sheet stock.

The invention has been described hereinabove with primary reference to manufacture from a thermoplastic material by a process such as injection molding. Those skilled in the art will appreciate, however, that it can also be manufactured from sheet stock of a suitable plastic (such as 1/32" polyethylene), and attention is directed to FIG. 5.

A sheet of plastic 82 is uncoiled from a roll (not shown) and moved 84 by an indexing drive to a plurality of work stations. In such processing, it is common to provide indexing holes 86 to insure precise registration. At the initial stations, score lines 34, 36 etc. are embossed in the sheet. Then, cut-out portions 44, 68 are sheared and, in a minor variation, a pair of slits 88, 90 are cut across score line 60, and a rectangular section 92 is formed that can be heat sealed to sections 38, 48 forming a right angle at corner 64.

In this case, it is also necessary to add snap elements 28, 32 and blade 14 by heat sealing at separate stations. As an alternative to slits 88, 90 and rectangular section 92, a separate element may be heat sealed in place and accomplish the same function. After these steps the sides of adjoining razor blanks are severed down just past score line 50, the blade is inserted on bosses 39, and the blade holder portions are folded and sealed. Lastly, the remaining edges are severed to form individual units. The precise amount of "work" done at each station is the function of the tool designer.

Various changes in the details, steps, materials and arrangements of parts, which have been described and illustrated to explain the nature of the invention, may be made by those skilled in the art, within the principle and scope of the invention as defined in the appended claims.

What is claimed is:

1. A disposable, foldable razor comprising:

a handle section, a blade, a blade holder section supporting said blade and a blade holder support section integral with said handle at its lower edges and integral with said blade holder at its upper edge;

said blade holder comprising upper and lower folded-together surfaces including said blade therebetween and an intermediate cut-out portion exposing the edge of said blade, and a back wall integral with said upper surface and maintained at a right angle thereto, said back wall at its lower edge being in integral, folding relation with the upper edge of said blade holder support section;

said handle and blade holder support sections together comprising in the flat position a rectangular section in integral folding relation at its upper edge with the lower edge of said blade holder section;

said handle section including (1) a pair of intermediate spaced, parallel, transverse score lines whereby the lower portion of said handle may be folded up so that its lower edge is in spaced, parallel relation with the line joining said blade holder and blade holder support sections, (2) a pair of spaced, parallel longitudinal score lines and an upper transverse score line between the upper ends thereof integral with said blade holder support section, whereby said handle may be folded along same into a general "U" shape, and (3) retainer means for holding said lower portion in a folded position defined in (1) and in the "U" shape defined in (2); and said blade holder support section including a first pair of score lines extending from the ends of said upper transverse score line upwardly and outwardly across said back wall to the distal edges of said right angle, a second pair of score lines extending from the ends of said upper transverse score line downwardly and outwardly to the edges of said rectangle, and defining with said upper transverse score line the integral, foldable boundaries of said handle and blade holder support sections.

2. The disposable, foldable razor as claimed in claim 1, and including reinforcing means to maintain said upper surface and back wall at a right angle.

3. The disposable, foldable razor as claimed in claim 1, wherein said retainer means comprise ball-and-socket snap locks.

4. The disposable, foldable razor as claimed in claim 1, wherein said handle, blade holder support and blade holder sections comprise an integral, one-piece injection molding including living hinges at all said score lines and foldable junctions.

* * * * *